United States Patent [19]

Hertell et al.

[11] Patent Number: 4,604,041

[45] Date of Patent: Aug. 5, 1986

[54] ROTARY VANE PUMP

[75] Inventors: Siegfried Hertell; Robert Lange, both of Radevormwald, Fed. Rep. of Germany

[73] Assignee: Barmag Barmer Maschinenfabrik Aktiengesellschaft, Remscheid, Fed. Rep. of Germany

[21] Appl. No.: 721,325

[22] Filed: Apr. 9, 1985

[30] Foreign Application Priority Data

Apr. 9, 1984 [DE] Fed. Rep. of Germany ..... 3413299
Jun. 26, 1984 [DE] Fed. Rep. of Germany ..... 3423426

[51] Int. Cl.[4] ..... F04C 18/00; F04C 29/00
[52] U.S. Cl. ..... 418/82; 418/268
[58] Field of Search ..... 418/82, 93, 184, 267, 418/268, 269, 145–148, 253–256

[56] References Cited

U.S. PATENT DOCUMENTS

| | | | |
|---|---|---|---|
| 397,516 | 2/1889 | Powers | 418/184 |
| 704,638 | 7/1902 | Hodgson | 418/255 |
| 2,410,596 | 11/1946 | Bradford | 418/145 |
| 3,598,510 | 8/1971 | Aoki | 418/268 |

FOREIGN PATENT DOCUMENTS

| | | | |
|---|---|---|---|
| 1260214 | 3/1961 | France | 418/82 |
| 26-6486 | 6/1951 | Japan . | |
| 440212 | 1/1936 | United Kingdom . | |
| 846119 | 8/1960 | United Kingdom . | |
| 1231187 | 5/1971 | United Kingdom . | |
| 1565969 | 4/1980 | United Kingdom . | |

*Primary Examiner*—Leonard E. Smith
*Assistant Examiner*—Jane E. Obee
*Attorney, Agent, or Firm*—Bell, Seltzer, Park & Gibson

[57] ABSTRACT

A rotary vane pump is disclosed which comprises a cylindrical housing, and a cylindrical rotor eccentrically mounted for rotation within the housing. The rotor includes a slot mounting a pair of oppositely oriented hook-shaped vanes, so as to define a hook space adjacent each end of the overlying vanes. A fluid, such as lubricating oil, is delivered to each hook space during that portion of its rotation shortly before its bottom dead center position, and the delivered fluid is pressurized during that portion of its rotation shortly after its bottom dead center position to assist in moving each vane outwardly from its bottom dead center position.

16 Claims, 20 Drawing Figures

ROTARY VANE PUMP

The present invention relates to a rotary vane pump adapted for use as a vacuum pump in an automobile or the like.

A rotary vane pump is disclosed in Japanese Utility Pat. No. 26-6486, comprising a cylindrical housing which eccentrically mounts a rotor, and wherein the rotor includes a pair of hook-shaped vanes which slideably overlie each other in a guide slot in the rotor. Such rotary vane pumps have a problem in that the vanes must sealingly contact the circumference of the housing during rotation of the rotor, and as a result, the blades perform constantly repeated radial inward and outward movements. In known pumps, this problem is particularly pronounced at the rotated position of the rotor wherein the overall length of the vanes equals the diameter of the housing, referred to herein as the maximum position of the rotor or vanes. In such maximum position, the vane which has moved inwardly to fully enter the rotor slot has its center of gravity very close to the axis of rotation of the rotor, and it may even be positioned beyond the rotor axis. As a result, a certain range of rotation after the maximum position does not possess adequate centrifugal force to ensure that the fully immersed vane will move outwardly in contact with the peripheral wall of the housing.

For the above reason, known vane pumps include a spring biased between the two vanes, but this construction has the disadvantage in that the spring force is weakest at the maximum position of the rotor, where it is most needed to move the vane out from its bottom dead center position. In the position of the rotor rotated 90° to the maximum position, in which the overall length of the vanes is minimum, the spring force is maximum. However, in the minimum position of the rotor, the center of gravity of the vane is clearly positioned on the exit side of the rotor axis, and as a result, the centrifugal force is adequate to move the vane outwardly, and the further force of a spring is unnecessary. The spring thus increases the frictional force between the vane and wall of the housing unnecessarily, resulting in a loss in efficiency.

It is accordingly an object of the present invention to provide a rotary vane pump whein a force is provided for moving each vane outwardly from its bottom dead center position, and wherein such additional force is active only until the centrifugal force is adequate to ensure the outward movement of the vane.

These and other objects and advantages of the present invention are achieved in the embodiments illustrated herein by the provision of a rotary vane pump which comprises a cylindrical housing, and a cylindrical rotor eccentrically mounted for rotation within the housing, with the rotational axes of the housing and rotor defining a dead center plane. The rotor includes a slot extending along the axial direction thereof and diametrically therethrough, and a pair of overlying vanes are slideably mounted in the slot for radial movement with respect to each other and said slot during rotation of the rotor. Each of the vanes has a generally hook-like outline in cross section, and comprises a shank portion having a bottom edge at one end thereof and a laterally offset head portion at the other end thereof. The head portion has a width which is approximately the same as the width of the rotor slot, and is twice the width of the shank portion. Also, the shank portions of the vanes overlie each other within the slot with the head portions at respective opposite ends of the slot and so as to define a hook space between each head portion and the bottom edge of the other vane. Further, the rotor and vanes are dimensioned so that each hook space enters the slot during the portion of each rotation of the rotor between about 90° before the bottom dead center position, which lies along the dead center plane at the point where the surfaces of the housing and rotor are closest, and 90° after the bottom dead center position. The rotary vane pump further comprises means for providing a fluid in each hook space during that portion of each rotation of the rotor between the bottom dead center position and the point at which the hook space leaves the slot, and means are also provided for pressurizing the fluid provided in each hook space during that portion of each rotation, so as to assist in moving the head portion and the associated vane radially outwardly.

In accordance with the preferred embodiments, the fluid is provided to each hook space during that portion of the rotation of the rotor in which the hook space has entered the slot and prior to its bottom dead center position. Also, more particularly, the rotor and vanes are dimensioned so that the hook space enters the rotor slot when the rotor moves into the minimum position i.e. 90° before the bottom dead center position. As a result, the hook space is closed, by the fact that the hook head is immersed in the slot, and the end walls of the chamber close the opposite ends of the hook space.

In accordance with a preferred embodiment, the hook space is filled with oil between the 90° position and the bottom dead center position. This is preferred in that the hook space naturally increases in volume, since during this portion of the rotation the overall length of the vanes is increasing. As a result, the lubricating oil may naturally be sucked into the hook space. However, in accordance with the present invention, the hook space may be connected at one point, or along a portion of its range of rotation between the 90° position and the bottom dead center position, to a source of oil, such as the source of the lubricating oil of the automobile engine. As a further aspect of the present invention, the hook space is connected via a throttle to the reservoir of lubricating oil during rotation between its bottom dead center position and the minimum position following the bottom dead center position. The throttle is so designed that an adequate pressure develops in the hook space, by reason of the natural reduction of the hook space within this range of rotation, so as to push the emerging vane outwardly and to bring it into contact with the peripheral wall of the housing.

As noted above, the hook space is immersed in the slot at the minimum position of the vanes, before the bottom dead center position, and similarly, it moves out of the slot in the minimum position after the bottom dead center position, so that the additional pressure applied to the outwardly moving vane terminates at that point at the latest.

As a further aspect of the present invention, an outlet for the hook space may be provided within the range of rotation between the bottom dead center position and the minimum position thereafter, which includes a variable throttle. In particular, th throttle may be designed so that the pressure in the hook space is suddenly reduced before the minimum position following dead center is reached. An additional outlet in the form of a radially defined notch on the front side of the hook portion may also be provided, which effects a premature connection between the hook space and the interior of the housing for the purpose of reducing the pressure.

The oil supply to the hook space, and the throttled oil outlet from the hook space, may for example be provided by a groove formed into the end wall of the housing, with the groove extending over a pitch circle that is crossed by the hook space as it moves from the initial minimum position through bottom dead center to the opposite minimum position. The cross section of the groove may be varied in accordance with the desired throttling, during the latter portion of this rotational movement.

The oil supply and the throttled oil outlet may alternatively be provided by means of an annular recess in one end face of the rotor. The outside radius of the recess is sufficiently large so that it communicates with the hook space between the 90° minimum position and the bottom dead center position, to thereby connect the hook space with an oil supply. After having passed the bottom dead center position, the oil that has entered the hook space is pressed outwardly from the hook space and through the recess. A desired throttling is accomplished by a reduced depth of the recess at that point. It is preferred that the recess has a variable depth in the radial direction, with the depth being maximum in the outer portions of the recess, so as to permit an unthrottled escape of the oil from the hook space shortly before the minimum position after bottom dead center is reached.

In another embodiment, at least one end wall of the housing is provided with an additional, essentially radially directed groove or recess at a location shortly before the minimum position after the dead center position, and which is crossed by the hook space when it enters into this range of rotation. As a result, the throttling effect is suddenly discontinued.

The rotary vane pump of the present invention is adapted for use as a vacuum pump in an automobile, for example, for increasing the braking force or for various servo drives, such as those associated with fuel injection. The pump has the advantage of a high volumetric output, yet it is very small in dimensions and it has a high efficiency.

When used as an air or vacuum pump in an automobile, further steps may be provided to facilitate the starting of the pump under cold or low temperature conditions. At low temperature, the lubricating oil is highly viscose, and in addition, the impurities of the oil may have become deposited in solid form during non-operation to cause the vanes to stick. To avoid this problem, a spring having a limited travel stroke may be provided in the hook space on the bottom edge of the shank portion of one vane or on the underside of the hook portion of the other vane, with the spring serving to push the vanes resiliently apart in the minimum position and possibly also in a small range of rotation before and after the minimal position. This spring may take the form of a bimetallic spring which is so designed that it projects into the hook space only in a cold condition.

The cold start of the pump may also be assured by supplying a pressurized oil in the hook spaces upon their entering into the rotor slot.

In a preferred embodiment, the rotary vane pump is lubricated with oil under substantially no pressure. However, valve means may be provided which closes at low temperatures, so as to create a pressure in the oil. This valve means may be achieved, for example, by a contraction in length during cooling or by a bimetallic effect.

In another embodiment wherein the pump is lubricated with oil, the pressure of the lubricating oil may be advantageously used to move the vanes outwardly. This is particularly applicable for vacuum pumps in an automobile of the gasoline injection type for increasing the braking force, or for the drive of other servomotors, and wherein the lubricating oil supply line is connected to the lubricating system of the motor and the outlet of which is connected with the oil pan of the motor.

As noted above, the housing, rotor, and vanes are so dimensioned that the hook spaces are immersed in the guide slot of the rotor in the range of rotation between 90° before and 90° after the bottom dead center position. In this range of rotation, the hook spaces communicate with an oil supply line, which is in turn connected to a source of lubricating oil such as a lubricating oil pump. To this end, one end face of the rotor or one front wall of the housing may have a recess in the form of a circular disk, into which the oil supply duct terminates. The recess is thus overlapped by the hook spaces after they have entered into the rotor slot. The oil supply bore is preferably coaxial with the axis of the rotor, and in such embodiment, there is a problem in that the lubricating oil may be sucked into the pump chambers which are under a low pressure. In such pumps, the discharge chamber of the pump may be further provided with a non-return valve, so that it is under a partial vacuum for such time until the outside pressure has been reached therein by a subsequent compression stroke. This design permits the power requirements of the vacuum pump to be reduced, since the difference of pressure on the opposite sides of each vane is very small, however, there is also a risk of oil being sucked into the discharge chamber which increases the oil required by the pump, and may lead to an oil shortage on other lubricating points of the automobile engine at a moment when the engine is operated at high speed and the pump sucks an unnecessarily high vacuum.

For the purpose of limiting the oil supply losses, the rotary pump may be provided with a slide valve arrangement on the shank portions of the vanes, in the form of recesses which extend from the bottom edge of the shank portion along a portion of the radial length of the vane. These recesses control the oil supply between the bore and the hook spaces by temporarily overlapping the oil supply duct so that their end edges pass over the oil supply duct as a function of the rotated position of the rotor. By this arrangement, the oil supply to the hook spaces may be controlled so that the oil pressure adequately assists the vanes as they move out from the bottom dead center position, and without leading to an unnecessarily high contact pressure which promotes wear and dissipates power. Further, this embodiment avoids an undesired outflow of oil into the suction and/or discharge chamber of the pump or the oil pan of the automobile engine.

The above described recesses in the shank portions of the vanes may be so dimensioned that the connection between the oil supply duct and the hook spaces is controlled so as to open immediately after the hook space has entered into the rotor slot, and to close immediately before the hook space emerges from the rotor slot. The recesses may be provided in one or both front edges of each vane. Similarly, the recesses may be formed into the backside of each vane which is opposite from the hook head. Where the vanes have cutouts in one or both edges of each vane, there is no effect on the contact pressure between the overlying vanes.

As indicated above, the oil supply duct may be positioned in a front wall of the housing, and concentric with the rotor. In an alternate embodiment, the oil supply duct is axially disposed in the rotor, and preferably, it has a diameter larger than the width of the slot. This provides a crescent shaped duct on each side of the pair of vanes, and the recesses or cutouts connect these crescent shaped ducts with the hook spaces at predetermined times.

The recesses in the edges of the vanes not only control the oil supply to the hook spaces, but in addition, it is important that the dimensions of the overlap of the recesses relative to each other control the oil flow from the oil supply duct into the housing. In particular, the recesses or cutouts are designed so that they do not overlap in the dead center position of the vanes. In the dead center position, one hook space has entirely emerged from the rotor, and in this position, a connection between the oil supply duct and the emerged hook space is precluded in that the vanes overlie each other along their entire width and the cutouts or recesses do not overlap.

To achieve an adequate sealing between the oil supply duct and the housing, the hook spaces should enter the rotor slot before the recesses or cutouts overlap the oil supply bore. Preferably, this should occur up to about 15° prior to the hook spaces entering the slot.

The present invention does not necessarily prevent the oil enclosed in the hook spaces from entering into the housing, and in particular into the discharge chamber, when the hook spaces emerge from the rotor slot. Also, oil is there desirable, in that it serves to lubricate the vanes and the rotor with respect to the housing wall. However, the present invention is intended to prevent these oil quantities from flowing through the pump outlet and into the crank case of the engine. Such discharges from the outlet of the pump involves a substantial loss in efficiency, and it is undesirable that the output capacity of the oil pump is thereby reduced at times of high oil consumption of other users.

To alleviate the discharge of oil, the present invention further provides that an angular groove system may be formed into one end wall of the housing at the end of the discharge chamber. This groove system includes a peripheral segment which extends into a portion of the discharge chamber, and preferably the bottom end area of this chamber. The peripheral branch preferably also overlaps a portion of the discharge chamber which is positioned behind (downstream) the end of the chamber outlet. It should be noted that for manufacturing reasons, as well as reasons relating to the need for an adequate seal, the outlet should not extend completely to the dead center position. As a result, the extreme end of the discharge chamber is a dead space.

The angular groove system further includes a radial segment which extends from the end of the peripheral segment to a point just short of the oil supply duct and essentially along the plane of the dead center position. A connecting segment extends from the end of the radial segment, substantially parallel to the peripheral segment, to such an extent that its end point is about 30°, and preferably between 30° and 60°, before the dead center position as measured from the center of the rotor. By this arrangement, the end area of the discharge chamber is connected to the oil supply duct via the peripheral segment, the radial segment, the connecting segment, and then the cutout or recess of the vane which approaches the upper dead center position. At this point, the oil in the remainder of the discharge chamber may be removed via the groove system into the oil supply duct. The groove depth, however, is relatively shallow, and in addition, the groove system is angled between the peripheral segment and the radial segment so that a strong throttling occurs. As a result, oil flow fom the oil supply duct into the discharge chamber is prevented, while the discharge chamber is under a vacuum. In addition, the oil accumulating in this end area of the discharge chamber may be removed, when the pressure in the chamber equals the pressure in the oil supply duct, via the groove system. The oil thus again becomes available for both lubrication and assisting in the movement of the vanes.

Some of the objects having been stated, other objects will appear as the description proceeds, when taken in connection with the accompanying drawings, in which—

Figure 1:
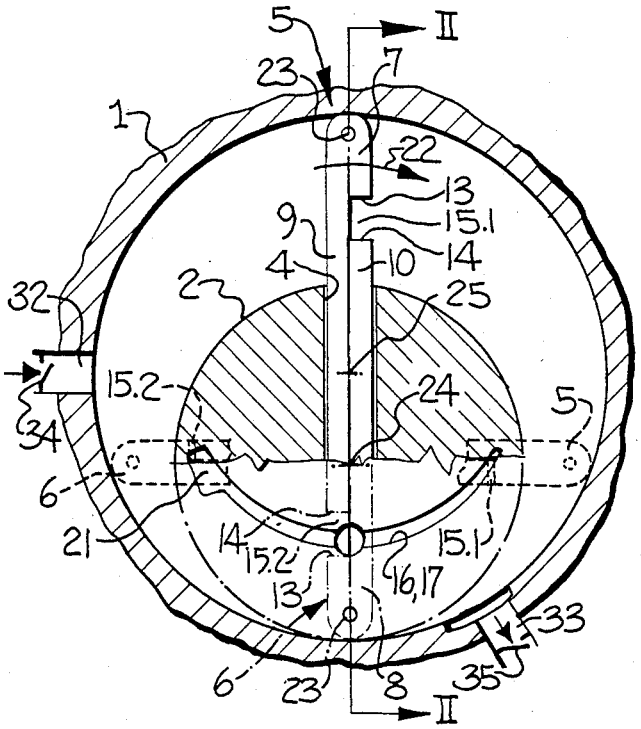
FIG. 1 is a sectional front elevation view of a rotary vane pump which embodies the features of the present invention.
Figure 2:
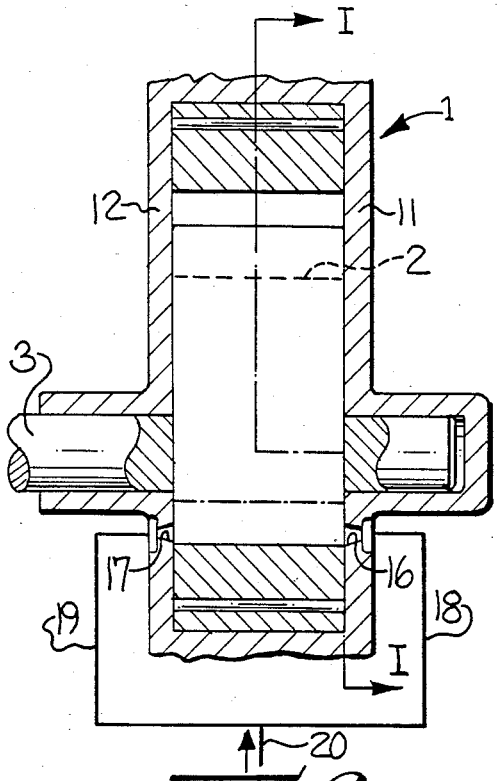
FIG. 2 is a sectional side view taken substantially along the line II—II in FIG. 1.
Figure 3:
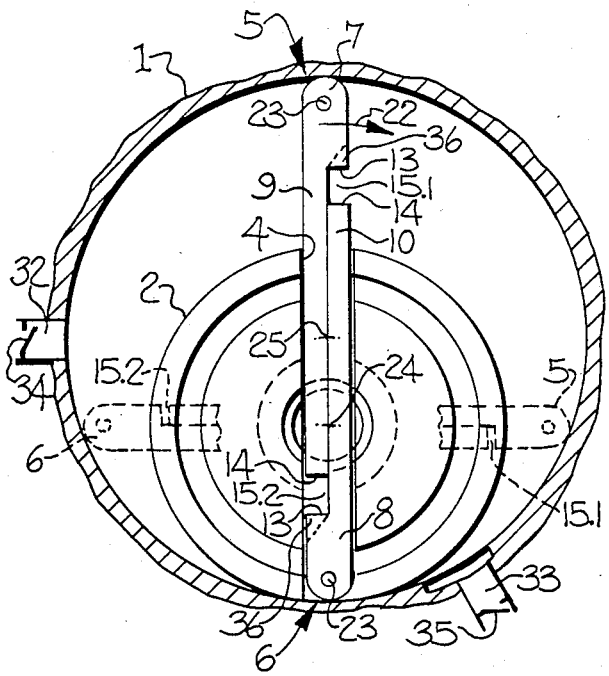
Figure 4:
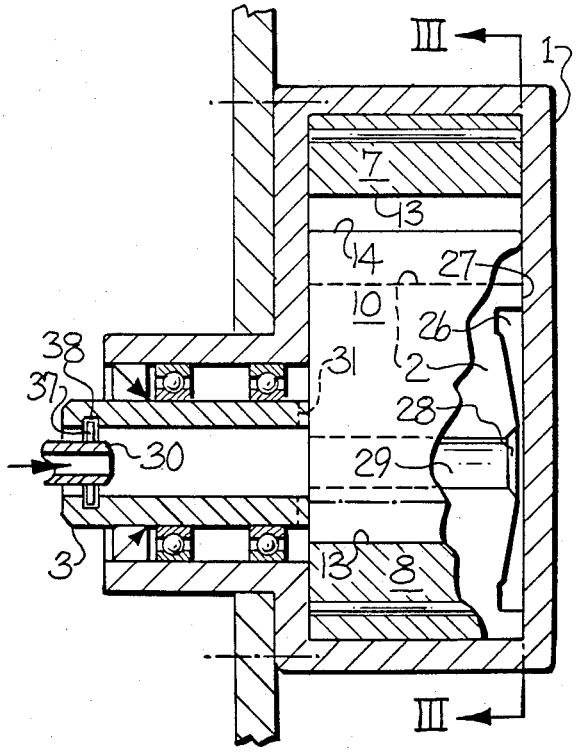
Figure 5:
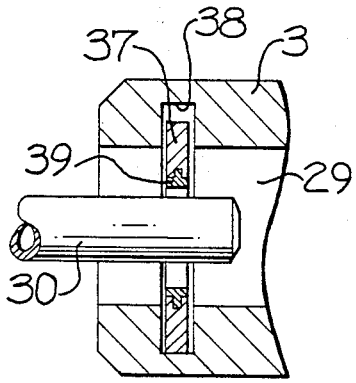
Figure 6:
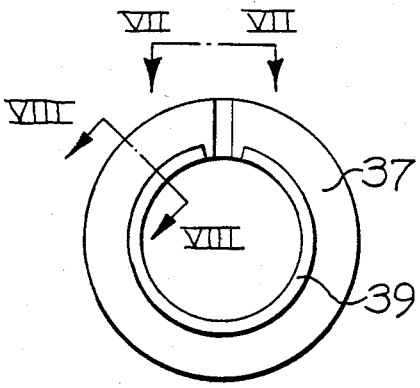
Figure 7:
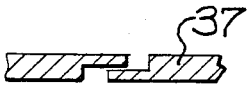
Figure 8:
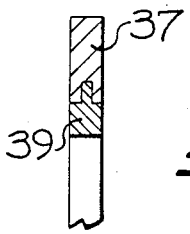
Figure 9:
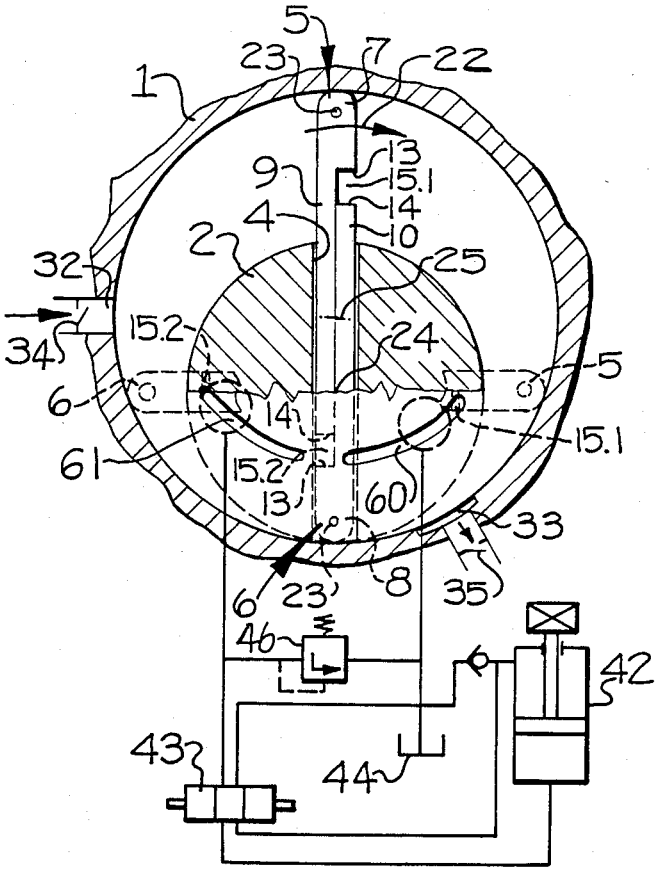
Figure 10:
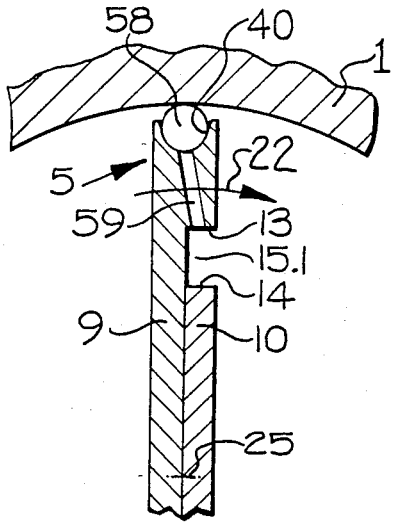
Figure 11:
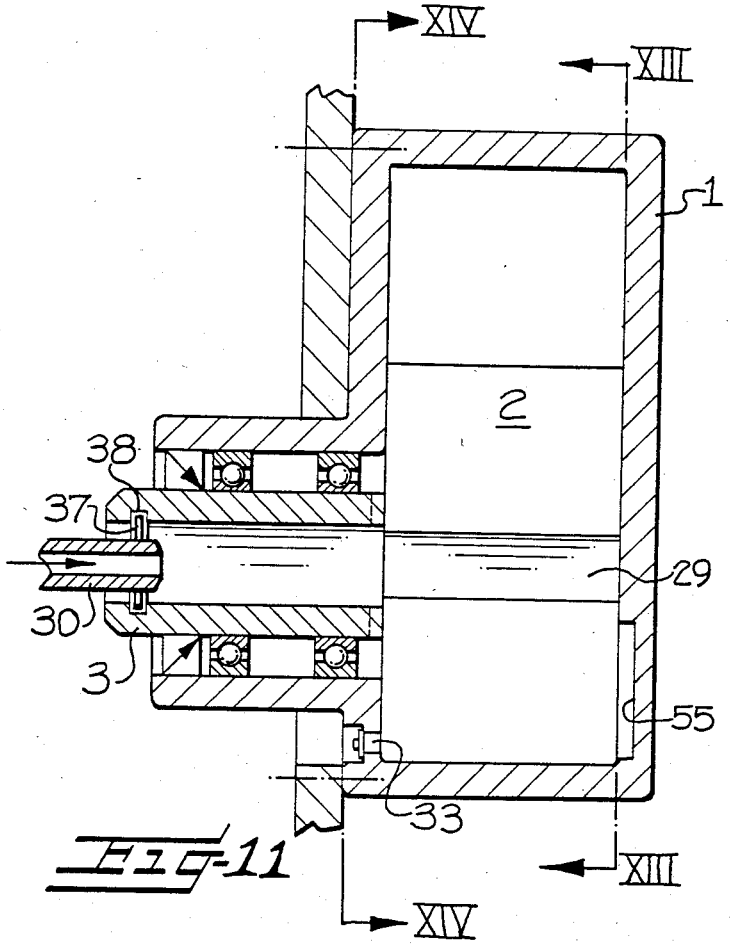
Figure 12A:
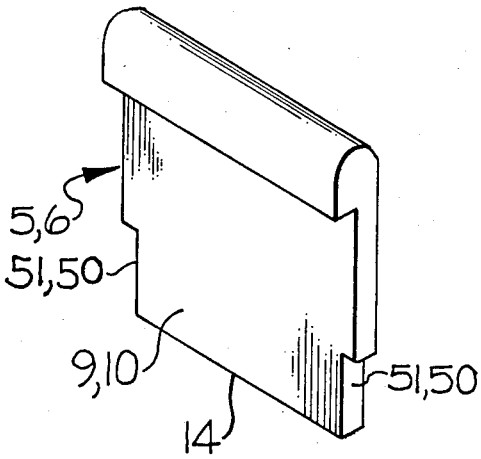
Figure 12B:
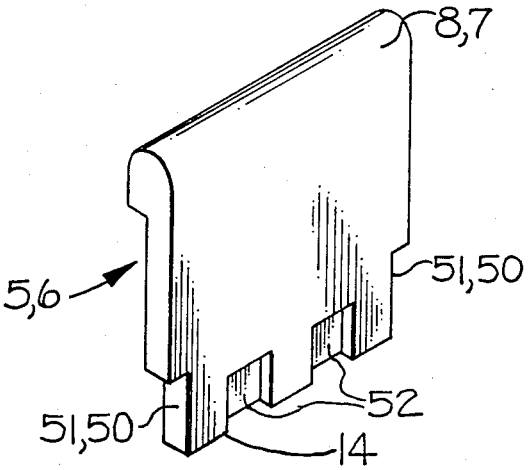
Figure 14A:
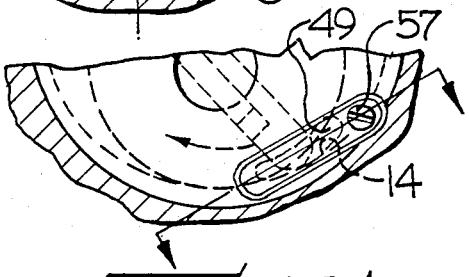
Figure 14B:
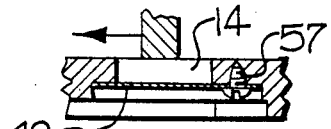

FIGS. 3 and 4 correspond to FIGS. 1 and 2 respectively, but illustrate a second embodiment of the invention;

FIG. 5 is a fragmentary sectional view of the valve means shown in FIG. 4;

FIG. 6 is a front elevational view of the valve means shown in FIG. 5;

FIGS. 7 and 8 are fragmentary sectional views taken substantially along the lines VII—VII and VIII—VIII of FIG. 6;

FIG. 9 is a view similar to FIG. 1 and illustrating still another embodiment of the present invention;

FIG. 10 is a fragmentary sectional view illustrating one embodiment of a vane in accordance with the present invention;

FIG. 11 is a sectional side elevation view of a further embodiment of the present invention;

FIGS. 12A and 12B are perspective views of the vanes utilized in the embodiment of FIG. 11;

FIGS. 13A through 13E are front sectional views of the embodiment shown in FIG. 11, and illustrating the rotational movement of the rotor and associated vanes;

FIG. 14A is a fragmentary sectional view taken substantially along the line 14—14 in FIG. 11; and FIG. 14B is a fragmentary sectional view taken substantially along the line 14B—14B of FIG. 14A.

Referring more particularly to the drawings, there is disclosed in FIGS. 1 and 2 a rotary vane pump which comprises a cylindrical housing 1 having a center axis 25, a fluid inlet 32, and a fluid outlet 33. A cylindrical rotor 2 is eccentrically mounted for rotation within the housing about the axis 24, and the rotor includes a slot 4 extending along the axial direction thereof and diametrically through the rotor. The rotor is attached to an integral shaft 3 which is driven by a suitable motor (not shown) such as the cam shaft of an automobile engine. The rotational axes 24 and 25 will be seen to define a dead center plane which lies along the line II—II of FIG. 1.

A pair of overlying vanes 5 and 6 are slideably mounted in the slot for radial movement with respect to each other and the slot during rotation of the rotor. Each of the vanes has a generally hook-like outline in cross section and comprises a shank portion 9, 10 having a bottom edge 14 at one end thereof and a laterally offset head portion 7, 8 at the other end thereof. The head portion has a width which is approximately the same as the width of the rotor slot, and is twice the width of the shank portion. To prevent the shanks from sticking to each other, particularly during a cold start, both shank portions, or at least one shank portion, may be provided with a recess extending over its entire width or a portion thereof. In the radial direction, such recesses are so dimensioned that they do not emerge from the rotor slot in any rotated position of the rotor. In other words, the recesses are sealed by the side walls 11, 12 of the housing in any rotated position. The underside 13 of each hook portion forms a so-called hook space 15.1 or 15.2, with respect to the bottom edge 14 of the shank portions.

It will be noted that the vanes 5 and 6 have corresponding shapes. Further, the illustrated rotational position of the rotór 2 as shown in FIGS. 1 and 3 is described herein as the maximum position of the vanes. In this maximum position, the vanes lie along the dead center plane and have their greatest overall length, from the hook portion of one vane to the hook portion of the other, in the radial direction. This overall length equals the inside diameter of the housing 1. As illustrated, the vane 6 is in its radially innermost or bottom dead center position relative to the rotor, whereas the vane 5 is in its radially outermost or upper dead center position. Accordingly, in the maximum position, the hook spaces 15.1 and 15.2 also have their maximum separation or size.

FIGS. 1 and 3 also illustrate in dashed lines the rotational position of the rotor and vanes in what is described as their minimum position. Here, the overall length of the vanes in the radial direction of the rotor is minimal due to the eccentricity of the rotor 2 relative to the housing. As a result, the volume of the hook spaces is smallest. The radial length of the hook portions 7, 8, and the radial length of the shank portions 9, 10, are so dimensioned that the hook spaces have a minimum value in the minimum position. In other words, the underside 13 of the hook portions 7, 8 almost contact the bottom edges 14 of the shanks 9, 10 respectively.

The inlet 32 and the outlet 33 are respectively closed by a non-return valve 34, 35 respectively. As a result, a return or counterflow is precluded with respect to both the inlet 32 and outlet 33.

In accordance with the present invention, the radial length of the hook portion, and the rotor radius, are so dimensioned that the undersides 13 of the hook portions fully enter into the rotor slot in the area of the minimum position. This means that from the minimum position forward, the hook spaces are closed by the rotor slot 4 and the end walls 11, 12 of the housing. The invention further provides that the hook spaces are filled with oil during their travel from the minimum to the maximum position, and that the oil is then discharged via a throttle between the maximum or dead center position, and the minimum position on the opposite side of the bottom dead center position. For this purpose, in the embodiment of FIGS. 1 and 2, arcuate slots 16 and 17 are provided in the side walls 11 and 12 respectively, with the slots being connected via lines 18, 19 with a source of oil 20, which may be oil under a very slight pressure and which otherwise serves as a lubricating oil for the pump. The slots 16 and 17 are positioned so that they communicate with the hook spaces as the rotor rotates. The cross section of the slots increases from the minimum position to the bottom dead center position, and then again decreases from the dead center position to the area of the minimum position. Shortly before reaching the minimum position, the cross section of the slots widen sharply to form an outlet area 21.

The operation of the pump illustrated in FIGS. 1 and 2 will now be described. With the rotor 2 rotating in the direction 22, the hook space 15.1 will enter into the rotor slot 4 at about the minimum position. The volume of the hook space 15.1 then increases between such minimal position and the bottom dead center position of the hook space. Since in this range of rotation the hook space 15.1 communicates with the slots 16 and 17, the hook space receives oil from the slots. In the bottom dead center position of the hook space, the vane 5 has reached its innermost radial position with respect to the rotor, i.e., the bottom dead center position of the vane 5. At the same time, the other vane 6 has reached its outermost position, i.e., its upper dead center position. This means that the volume of the hook space 15.1 starts to reduce again from the bottom dead center position, and as it does so, the oil is forced outwardly via the slots 16 and 17. Since the slots have a relatively narrow cross section, the oil flow through the slots is throttled, so that the pressure builds up in the hook space 15.1, which is adequate to push the vane 5 from its bottom dead center position radially outwardly. Approximately 10° to 20° before the minimal position, the hook space 15.1 passes over the widened outlet area 21, causing the pressure in the hook space 15.1 to drop suddenly. This avoids unnecessarily high forces being exerted on the outwardly moving vane 5 beyond that point. The same functions are achieved when the vane 6 and hook space 15.2 pass the range of rotation between the minimal position and maximum position, and then back to its minimal position. As can be seen, the design of the slot cross section permits the pressure in the hook spaces to be adjusted, and thus the contact pressure at which the vanes are pushed outwardly, to optimum values. The pressure distribution should also be related to the conditions of the center of gravity of the vanes.

In the present invention, the center of gravity of the vanes is influenced by a weight 23, for example a metal bar, which is inserted into each hook portion. This serves or aids the purpose of positioning the center of gravity of each vane so that in the bottom dead center position of the vane, the ceter of gravity does not extend beyond the center axis 24 of the rotor.

As illustrated, the vanes are preferably inserted so that the hook spaces are forwardly directed, when viewed in the direction of rotation of the rotor. This orientation provides that the pressure forces operative on the upper side and underside of each hook portion are balanced on the pressure side of the pump, whereas on the suction side of the pump, the radial outward movement of the vane is assisted by the partial vacuum.

Referring now to the embodiment of FIGS. 3 and 4, the oil is supplied via an annular recess 26 which is formed into an end face of the rotor 2. The recess 26 is sealed about the circumference of the rotor by an annular rim 27, and communicates via an annular gap 28 with the duct 29 of the hollow shaft 3. An oil supply line 30 communicates with the duct 29. Oil may be supplied through the oil supply line 30 into the duct 29, under essentially zero pressure. Since the diameter of the duct 29 is larger than the width of the slot 4, the oil can flow around both vanes. In this regard, it will be noted that in FIG. 4, the vanes are not shown in the slot but are shown only in dashed lines, so as to permit better illustration of the configuration of the rotor.

It should further be noted that the slot in the rotor continues rearwardly into the tubular shaft 3; to form a recess 31 having a short axial length. The recess 31 permits the oil to enter into the bearing area for the purpose of lubrication.

The recess 26 in the front end face of the rotor has a shallow depth which preferably varies over its radius. Each hook space 15.1 and 15.2 receives oil from the recess 26 between the minimum position and the bottom dead center position, and oil is discharged therefrom during rotary movement between the bottom dead center position and the following minimum position. Due to the shallow depth of the recess 26, the oil flow is throttled, and by shaping this depth a throttling may be achieved which varies during the rotary movement. The area of greatest depth in which throttling is essentially terminated, is crossed shortly before the following minimum position, so that there, the pressure in the respective hook space is decreased.

Prior to reaching the minimum position after the bottom dead center position, the pressure can also be relieved by means of a notch 36 as shown in dashed lines in FIG. 3, and which is formed into the front side of the hook portion. The notch thereby connects between the annular recess 26 and the rotor through the rim 27 and the periphery of the rotor, at a preselected time shortly before the minimum position is reached. This arrangement may be used in particular as an alternative to the annular cavity of the recess 26.

During a cold start of the vacuum pump, in particular at temperatures below 0° C. the lubricating oil becomes very viscose. As a result, there is a risk that the movement of the vanes may be impeded and there will be no pumping effect. In cases where the vacuum pump serves, for example, to increase the braking effect, a malfunction of this type could have serious consequences. This problem may be avoided in the embodiment of FIGS. 1 and 2, by temporarily supplying pressurized oil via the line 20. The pressure is selected to be sufficient to push the vanes outwardly and to make them sealingly contact the wall of the housing. To apply pressure to the oil, an appropriate thermosensitive valve may be provided. In the embodiment of FIGS. 3 and 4, such a thermosensitive valve is provided in the hollow shaft 3 in the form of a ring 37 inserted in a groove 38. In the cold condition, the ring 37 narrows the cross section of the flow between the oil supply line 30 and the inside circumference of the supply duct 29 to such an extent that a pressure builds up in the duct 29. Details of the ring 37 and groove 38 are shown in FIGS. 5–8. As illustrated, the ring is divided at one portion, with the ends of the ring overlapping each other. On its inner circumference, the ring has a metallic, highly thermosensitive, annular, but not closed insert 39, which is firmly connected with the remainder of the ring body, note FIG. 8. The ring 37 itself consists of a thermally non-sensitive material, such as plastic, which has only a slight contraction when cooled as compared with the metallic insert 39. By reason of the strong contraction of the metallic insert 39 when cooled, the diameter of the ring 37 becomes smaller by reason of the bimetallic effect. As a result, the gap width between the duct 29 and the oil supply line 30 reduces, and the oil pressure may build up in the duct 29. When heated, the inside diameter of the ring 37 is enlarged, so that the oil may again flow out of the duct 29 without a throttling effect.

In the embodiment of FIGS. 9 and 10, the rotary pump is configured so as to simultaneously act as a vacuum pump and a hydraulic oil pump. The rotary pump may thus simultaneously serve to drive pneumatic servomotors, such as for example, a device to increase the braking force, as well as hydraulic motors, such as are used as level regulators in automobiles. It should be noted that the pump shown in FIG. 9 corresponds essentially to that shown in FIGS. 1 and 2, with common numerals being employed. In the embodiment of FIG. 10, which is a fragmentary view of a hook portion, the hook portion includes a bearing race 40, in which a roller bearing 58 is rotatably supported. The bearing race is connected via several, successively arranged pressure equalizing ducts 59, which communicate with the associated hook space 15.1.

Referring now to FIG. 9, the pump is designed so that during rotation of the rotor in the direction of arrow 22, the hook space 15.1 enters the slot 4 shortly before the minimum position, which is shown in dashed lines, so that the hook space 15.1 forms a closed cavity. As the rotor continues to rotate, this now completely enclosed space 15.1 communicates first with a supply slot 60, and after reaching the bottom dead center position, the enclosed space then communicates with a following outlet slot 61. The outlet slot 61 extends between the bottom dead center position and the following minimum position, so that the respective hook space 15.1 does not produce a short circuit in the bottom dead center position between the supply slot and the outlet slot.

The supply slot 60 and the outlet slot 61 are positioned in a user circuit, which is schematically illustrated in FIG. 9. The user circuit includes an output pump 42, a controllable valve 43, a tank 44, and a pressure relief valve 46. The supply slot 60 represents the suction side of the hydraulic pump which is connected with the tank 44. Here, the hook spaces draw in oil as their volume increases, and during rotational movement between the minimum position and the bottom dead center position. During rotational movement between the bottom dead center position and the following minimum position, this quantity of oil is then discharged as the volume of the hook spaces decreases, and is delivered to the pump 42 under pressure. A pressure relief valve 46 is arranged between the user line leading from the outlet slot 61 and the tank line leading to the supply slot 60. This valve may be adjusted to a certain optimum pressure, which ensures that the head portions of the rotary vane pump always fully contact the housing wall, without causing an unnecessarily high friction.

In the embodiment of FIGS. 11–14, the rotor 2 and shaft 3 is supported in a housing in the manner described above. The rotor and shaft are formed of one integral piece, and are provided with a coaxial oil supply duct 29. The supply duct 29 connects to an oil supply line 30 which communicates with a lubricating oil pump (not shown). The oil supply line 30 is sealed against the duct 29 by a ring 37 inserted in a groove 38 in the manner described above. Specifically, in the cold condition, the ring 37 narrows the cross section of the flow between the oil supply line 30 and the inner circumference of the inside duct 29 to such an extent that a pressure builds up in the duct 29.

As in the prior embodiments, the width of the slot 4 approximately equals the sum of the thicknesses of the vanes 5 and 6. The diameter of the supply duct 29 is larger than the width of the slot 4, and as a result, crescent shaped ducts are formed on both sides of the vanes 5 and 6 and which extend lengthwise through the rotor on both sides of the vanes. The pump has an inlet 32 (note FIG. 13A) which is closed by a non-return valve, and an outlet 33 which is also closed by a non-return valve. As shown in FIGS. 14A and 14B, the outlet 33 is an arcuate opening through one side wall of the housing which is closed by a leaf spring 49 held against the direction of discharge. The leaf spring is mounted by means of a screw 57 on the end which is opposite the direction of rotation. This is of importance, for the proper function of the leaf spring 49 as a non-return valve.

As best seen in FIGS. 12A and 12B, the vanes are provided with channels in the form of cutouts 50 on both edges of their shank portions. These cutouts extend from the bottom edge 14 in a direction toward the hook portion. As is further shown in FIG. 12B, the channels may include recesses 52 which extend from the bottom edge 14 in a direction toward the head portion. The selection of the depth of the recesses or cutouts permits a determination of the flow characteristics of the oil, as further described below.

Figure 13A:
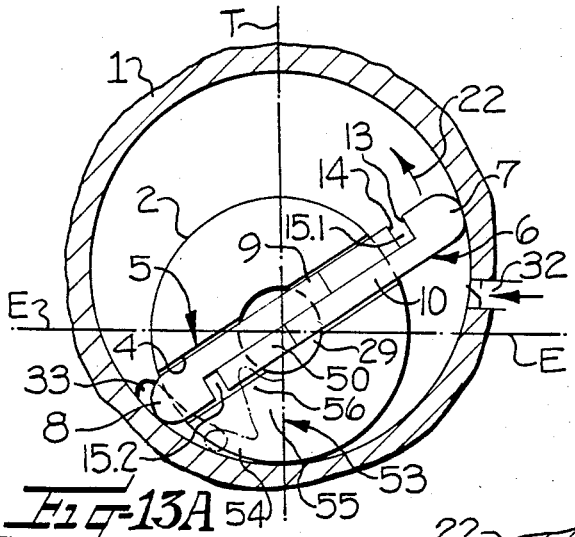
Figure 13B:
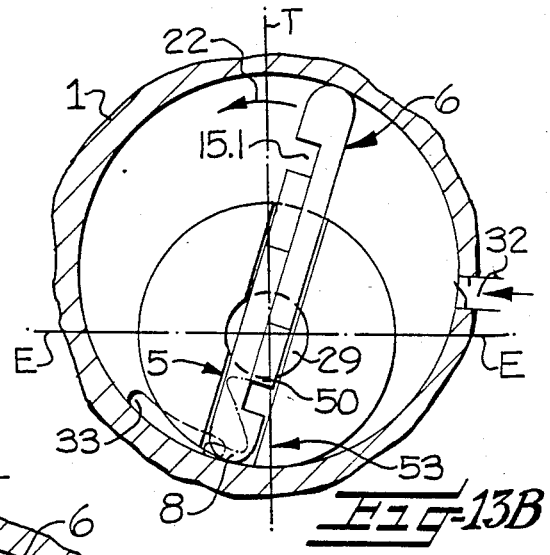
Figure 13C:
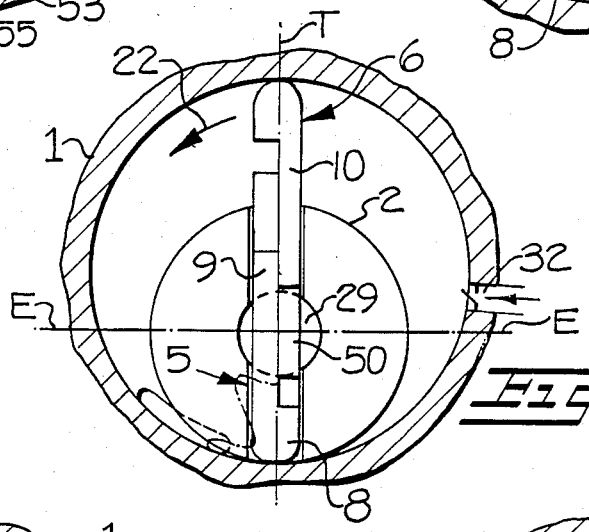
Figure 13D:
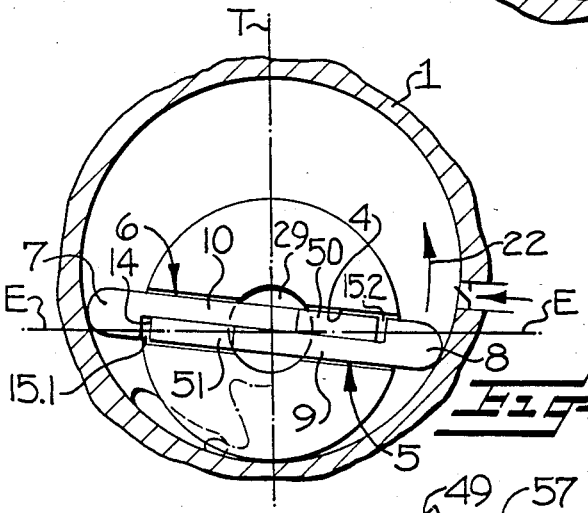
Figure 13E:
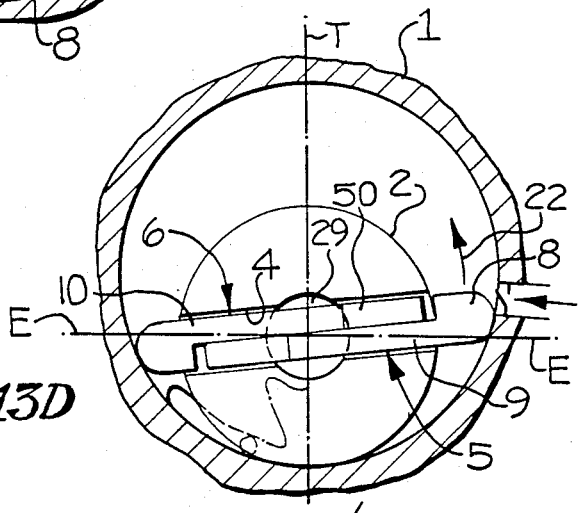

The dimensioning of the vanes, and in particular of their hook portions 7, 8, and their cutouts 50, as well as further details of the illustrated embodiment are further described in conjunction with FIGS. 13A–13E. In these figures, the line T indicates the dead center plane, on which are positioned the axes of the housing 1 and the rotor 2. Further, the rotor sealingly contacts the housing on this plane. In the rotated position of rotor 2 shown in FIG. 13C, in which position the vanes 5 and 6 are aligned in the dead center plane, the vane 5 has completely entered the rotor and is at its bottom dead center position, whereas the vane 6 is moved out of the rotor its maximum extent and is in the upper dead center position. The plane extending through the rotor center, which is 90° with respect to the dead center plane, is indicated in these figures by the line E. This position is described herein as the limiting position or 90° position. The limiting position is characterized in that the distance between the hook portions 7, 8 of the vanes is smallest, as can be seen in FIG. 13E.

In FIGS. 13A–13E, the direction of rotation is indicated by the arrow 22, and it will be noted that each hook space opens in the direction of rotation. In the rotated position of FIG. 13A, the hook space 15.2 has completely entered the rotor slot 4, and is connected, via cutout 50 in the shank portion 10, with the oil supply duct 29. As a result, the hook space 15.2 is under the pressure of the lubricating oil in the supply duct 29. At the same time, the shank portion 9 of vane 5 overlaps the oil supply duct 29 so that the oil supply duct 29 is not connected with the discharge chamber and the hook space 15.1.

An angled groove system 53, measuring 1–2 mm deep, is provided in the side wall of the housing. This groove system has a peripheral segment 54 which extends from the dead center plane T opposite the direction of rotation 22 and into the discharge chamber. The end of this peripheral segment 54 which extends into the discharge chamber overlaps in the circumferential direction the end of the outlet 33, which is formed in the opposite wall of the housing, note FIG. 11.

The groove system 53 further has a radial segment 55 which contacts the dead center plane and extends to a point just short of the supply duct 29. Further, the groove system 53 includes a connecting segment 56, which extends parallel to the peripheral segment 54 and also extends in a direction opposite the direction of rotation. The groove system 53 is shown in dashd lines in FIGS. 13A–13E, and it should be noted that the peripheral segment 54 and the radial segment 55 intersect at an angle to provide a strong throttling effect which is of importance for the functioning of this groove system.

To describe the function of the groove system 53 in more detail, it will be noted that the cutout 50 in the vane 6 has made connection with the segment 56 in the position of FIG. 13A. As a result, a connection has also been made between the end area of the discharge chamber of the pump and the oil supply duct 29. This end area is located between the vane 5 and the dead center plane. If there should be a partial vacuum in the discharge chamber, which is connected via outlet 33 and non-return valve 34 with the crank case of the automobile engine, or if there should be a short circuit between the discharge chamber and the space which precedes the chamber as defined by the two vanes 5 and 6, only a small quantity of the oil can flow from the oil supply duct 29 into the discharge chamber by reason of the strong throttling effect of the groove system 53. In particular, the throttling is provided by the angle between the radial segment 55 and peripheral segment 54, and the pressure of the lubricating oil in the duct 29 is thereby maintained. On the other hand, the groove system 53 makes it possible to return the oil or oil-air mixture which is present in the discharge chamber to the oil supply duct 29, as soon as an overpressure develops in the discharge chamber by reason of the movement of the vanes. The throttling of the oil supply will decrease as the overlap between the connecting segment 56 and the cutout 50 increases.

Upon reaching the rotated position shown in FIG. 13B, the discharge chamber is no longer connected with the outlet 33, and its entire contents, primarily oil, will be removed via groove system 53 and recess 50 into the oil supply duct 29.

At the dead center position of FIG. 13C, the connection between the discharge chamber and the oil supply duct 29 is closed, since the rear boundary of the radial segment is located substantially in the dead center plane, and the shank portion 9 of vane 5 covers the radial segment entirely at that position. The hook space 15.2 continues to be connected with the oil supply duct 29, and as a result, the pressure of the lubricating oil becomes operative on the vane 5 as the rotation continues in the indicated direction 22. This is of particular importance, since the vane is at its inner dead center position, and therefore, the centrifugal forces between the hook portion 8 and the other end of the vane are substantially balanced, so that only a slight centrifugal force is effective in the direction of outward movement. This unfavorable situation is corrected by the present invention in that the hook space 15.2 is connected with the oil supply, and the pressure of the oil serves to assist the outward movement of the vane 5.

As rotation continues to the position shown in FIG. 13E, the hook space 15.2 emerges from the rotor slot 4 shortly after having passed the limiting position. At this moment, the shank portion of vane 6 again fully covers the oil supply line 29, so that the cutout 50 no longer provides a connection between the pump chamber or the hook space 15.2 and the oil supply duct 29.

It will also be noted that the hook space 15.1 enters the rotor slot shortly before the limiting position, note FIG. 13D, and shortly thereafter the shank portion 10 of the vane 6 terminates the connection between the oil supply duct 29 and the hook space 15.1 via the cutout 51. As a result, the vane 5 now receives the pressure of the lubricating oil on its bottom edge 14, and is thereby further assisted in its outward movement. It is desirable that the entry of the hook space 15.1 int the slot and the application of pressure thereto (at the rotated position of FIG. 13D), and the emergence of the other hook space 15.2 proceed in a predetermined time sequence. This may be achieved if the rotor and vanes of the pump are so dimensioned that the leading edges of the hook portions and the leading edges of the cutouts provide the connection with the oil pressure duct at the desired times.

In the drawings and specification, there have been set forth preferred embodiments of the invention, and although specific terms are employed, they are used in a generic and descriptive sense only and not for purposes of limitation.

That which is claimed is:

1. A rotary vane pump adapted for use as a vacuum pump in an automobile or the like, and which comprises a cylindrical housing having a fluid inlet and a fluid outlet, a cylindrical rotor eccentrically mounted for rotation within said housing, with the rotational axes of the housing and rotor defining a dead center plane and with the surfaces of the housing and rotor being closely adjacent to each other at a bottom dead center position which lies along said dead center plane, said rotor including a slot extending along the axial direction thereof and diametrically therethrough, a pair of overlying vanes slideably mounted in said slot for radial movement with respect to each other and said slot during rotation of said rotor, each of said vanes having a generally hook-like outline in cross section and comprising a shank portion having a bottom edge at one end thereof and a laterally offset head portion at the other end thereof, with said head portion having a width which is approximately the same as the width of said rotor slot and twice the width of said shank portion, and with said shank portions of said pair of vanes overlying each other within said slot with said head portions at respective opposite ends of said slot and so as to define a hook space between each head portion and the bottom edge of the other vane, and with said rotor and vanes being dimensioned so that each hook space enters the slot during the portion of each rotation of said rotor between about 90° before said bottom dead center position and 90° after said bottom dead center position, and means for providing a fluid in each hook space during that portion of each rotation of said rotor between said bottom dead center position and the point at which the hook space leaves the slot, and means for pressurizing the fluid provided in each hook space during said portion of each rotation so as to assist in moving the head portion and the associated vane radially outwardly.

2. The rotary vane pump as defined in claim 1 wherein said means for providing a fluid in each hook space comprises a fluid supply duct extending coaxially through said rotor, and an annular recess formed in one end face of said rotor and communicating with said fluid supply duct, and with said annular recess communicating with the hook spaces during that portion of each rotation of the rotor in which the hook space has entered the slot and prior to its bottom dead center position, and that portion of each rotation between said bottom dead center position and the point at which the hook space leaves the slot.

3. The rotary vane pump as defined in claim 2 wherein said means for pressurizing the fluid provided in each hook space comprises a portion of said annular recess having a relatively shallow depth so as to act as a throttle to the fluid flowing outwardly from the hook spaces back to said fluid supply duct.

4. The rotary vane pump as defined in claim 1 wherein said means for providing a fluid in each hook space comprises means for supplying a fluid to each hook space during that portion of each rotation of said rotor in which the hook space has entered said slot and prior to its bottom dead center position.

5. The rotary vane pump as defined in claim 4 wherein said means for pressurizing the fluid received in each hook space comprises fluid outlet means communicating with the hook space during that portion of each rotation of said rotor between said bottom dead center position and the point at which the hook space leaves the slot, and fluid throttling means disposed in said fluid outlet means.

6. The rotary vane pump as defined in claim 5 wherein said fluid outlet means includes an outlet slot formed in the wall of said housing adjacent at least one end of said rotor, with said outlet slot positioned so as to communicate with each hook space during that portion of the rotation of said rotor between said bottom dead center position and the point at which the hook space leaves the slot, and said fluid throttling means comprises a predetermined width of said outlet slot so as to resist the expulsion of the fluid from the associated hook space.

7. The rotary vane pump as defined in claim 5 wherein said head portion of each vane includes bearing race and a roller bearing mounted therein so that the bearing is adapted to contact the wall of the housing, and a fluid duct extending through said head portion to interconnect the bearing race with the associated hook space.

8. The rotary vane pump as defined in claim 5 wherein said means for supplying a fluid in each hook space comprises an arcuate inlet slot formed in the wall of said housing so as to lie along the turning circle of the hook spaces, and wherein said fluid outlet means comprises an arcuate outlet slot formed in the wall of said housing so as to lie along the turning circle of the hook spaces.

9. The rotary vane pump as defined in claim 5 wherein said means for providing a fluid in each hook space and said fluid outlet means are part of a common fluid circulation system, and wherein the fluid is provided in said system under substantially zero pressure.

10. The rotary vane pump as defined in claim 9 wherein said fluid circulation system includes a fluid motor, and such that the fluid motor comprises said fluid throttling means.

11. The rotary vane pump as defined in claim 1 wherein said means for providing a fluid in each hook space comprises a fluid supply duct extending coaxially through said rotor, and the shank portion of each vane includes at least one channel extending radially from said bottom edge a predetermined distance toward the associated head portion, and such that the channel provides communication between said fluid supply duct and the associated hook space during that portion of each rotation of the rotor between the bottom dead center position and the point at which the hook space leaves the slot.

12. The rotary vane pump as defined in claim 11 wherein each channel of each vane is radially dimensioned so as to open communication between said fluid supply duct and the associated hook space upon the hook space having entered the rotor slot, and to close communication before the hook space emerges from the rotor slot.

13. The rotary vane pump as defined in claim 12 wherein said fluid supply duct has a diameter greater than the width of said slot in said rotor.

14. The rotary vane pump as defined in claim 12 wherein the axes of rotation of said cylindrical housing and said cylindrical rotor define a dead center plane and have closely adjacent portions which define a boundary along said plane between an intake chamber and a discharge chamber of said pump, and wherein said fluid outlet of said housing is disposed through a side wall of said housing in said discharge chamber and at a location immediate adjacent but spaced from said dead center plane.

15. The rotary vane pump as defined in claim 14 further comprising an angled groove system formed in the side wall of the housing opposite said fluid outlet, said angled groove system including a peripheral segment extending in a circumferential direction from said dead center plane and into a portion of the discharge chamber, a radial segment extending radially along the discharge chamber side of said plane and to a point spaced from said fluid supply duct, and a connecting segment which extends generally parallel to said peripheral segment adjacent said fluid supply duct, and with said connecting segment being located so as to communicate with said channels of said vanes at least 30° before reaching said bottom dead center plane.

16. The rotary vane pump as defined in claim 15 wherein said fluid outlet includes a non-return valve.

* * * * *